US006553893B2

(12) United States Patent
Murdoch

(10) Patent No.: US 6,553,893 B2
(45) Date of Patent: Apr. 29, 2003

(54) PISTON ASSEMBLY FOR REDUCING THE TEMPERATURE OF A COMPRESSOR CUP SEAL

(75) Inventor: Robert W. Murdoch, Woodstock, GA (US)

(73) Assignee: Respironics, Inc., Murrysville, PA (US)

( * ) Notice: Subject to any disclaimer, the term of this patent is extended or adjusted under 35 U.S.C. 154(b) by 109 days.

(21) Appl. No.: 09/817,435

(22) Filed: Mar. 26, 2001

(65) Prior Publication Data

US 2001/0047718 A1 Dec. 6, 2001

Related U.S. Application Data

(60) Provisional application No. 60/193,709, filed on Mar. 31, 2000.

(51) Int. Cl.[7] ..... F01B 31/08
(52) U.S. Cl. ..... 92/144; 417/201
(58) Field of Search ..... 417/571, 201, 417/569; 92/144

(56) References Cited

U.S. PATENT DOCUMENTS

| | | | | |
|---|---|---|---|---|
| 2,760,720 A | * | 8/1956 | Richardson | 417/571 |
| 3,996,913 A | | 12/1976 | Hamparian | 123/198 R |
| 4,172,363 A | | 10/1979 | Bex | 60/517 |
| 4,250,953 A | | 2/1981 | Bush | 165/1 |
| 4,516,481 A | | 5/1985 | Geffroy et al. | 92/212 |
| 4,536,132 A | * | 8/1985 | Tenney | 417/237 |
| 4,601,235 A | | 7/1986 | Roberts | 92/245 |
| 4,701,114 A | | 10/1987 | Andersen et al. | 417/564 |
| 4,831,828 A | | 5/1989 | Klusmier et al. | 62/6 |
| 5,064,359 A | | 11/1991 | Plummer | 417/489 |
| 5,454,397 A | * | 10/1995 | Miszczak | 137/512 |
| 5,456,287 A | * | 10/1995 | Leu | 137/855 |
| 5,562,431 A | * | 10/1996 | Plummer | 417/569 |
| 5,916,349 A | * | 6/1999 | Czabala | 92/144 |

OTHER PUBLICATIONS

"Air Compressors & vacuum Pumps, OEM Catalog and Selection Guide", Thomas Industries, Inc., pamphlet, date Unknown.

"Air Compressors, Rotary Vane, Piston Diaphragm Roc–R", Gast pamphlet, 5/90.

* cited by examiner

*Primary Examiner*—Charles G. Freay
*Assistant Examiner*—William H. Rodriquez
(74) *Attorney, Agent, or Firm*—Michael W. Haas

(57) ABSTRACT

A piston assembly for a compressor that reduces the temperature experienced by a compressor cup seal during operation of the compressor. The piston assembly includes a piston sleeve having a top portion and an interior. A valve plate is supported by the top of the piston sleeve. A compressor head includes a compressor head plate, which is offset from the valve plate. The offset between the compressor head plate and the valve plate defines a cooling chamber. The interior of the piston sleeve communicates with the interior of the compressor head via openings defined in the valve plate and the compressor head plate and conduit associated with these opening and traversing the cooling chamber.

19 Claims, 2 Drawing Sheets

PISTON ASSEMBLY FOR REDUCING THE TEMPERATURE OF A COMPRESSOR CUP SEAL

CROSS-REFERENCES TO RELATED APPLICATIONS

This application claims priority under 35 U.S.C. §119(e) from provisional U.S. patent application No. 60/193,709 filed Mar. 31, 2000.

BACKGROUND OF THE INVENTION

1. Field of the Invention

This invention generally relates to a piston assembly in a compressor, and more particularly, to a piston assembly having a piston valve plate offset from the bottom of the compressor head so as to define a cooling chamber between the piston valve plate and the compressor head for reducing the temperature of the piston sleeve and the cup seal of the piston to increase the operating life of the cup seal and the compressor.

2. Description of the Related Art

A compressor receives a supply of fluid, such as a liquid or gas, at a first pressure and increases the pressure of the fluid by forcing a given quantity of the received fluid from a first volume into a smaller second volume using a piston assembly. A typical piston assembly consists of a compressor head connected to a valve plate, a piston sleeve pressure seated with the valve plate by an o-ring, and a piston that travels inside the piston sleeve. Compression of the fluid is typically achieved when the piston moves upward during an upstroke, forcing a given quantity of fluid received in the piston sleeve during the downstroke into a smaller volume at the compressor head.

A cup seal, which extends from the midsection of the piston, frictionally engages the interior of the piston sleeve in order to provide a seal between the pressurized and non-pressurized sides of the piston. The cup seal is necessary to prevent fluid from escaping around the piston during the upstroke compression process. The cup seal flexes during the upstroke and downstroke of the piston and the frictional engagement creates wear along the cup seal. Furthermore, typically, the cup seal is manufactured from a flexible plastic material that is susceptible to wear from heat. For these reasons, the operating life of a compressor is often dictated by the useful life of the cup seal.

Heat is prevalent when compressing air. In a conventional compressor, the act of compression generates heat in the compressor head where the air is forced into a smaller space by the upstroke of the piston. This heat conducts from the compressor head to the piston sleeve via the valve plate. Heat then conducts from the piston sleeve to the cup seal, which further hastens failure of the flexible cup seal, limiting the life of the compressor. Reduction of the temperature of the cup seal extends its life, and ultimately extends the life of the compressor.

In a piston assembly design known as a hard joint assembly, the piston sleeve is seated directly into a groove in the valve plate, creating a metal-to-metal contact point between the piston sleeve and valve plate. Because, the valve plate also functions as the base of the compressor head forming an area in which the gas is compressed, the heat of compression in the compressor head is directly transferred to the cup seal through the piston sleeve from the metal-to-metal contact of the valve plate with the piston sleeve. While the hard joint assembly does have heat transfer disadvantages, an advantage of the hard joint assembly is the fixed clearance volume between the top of the piston and the valve plate when the piston is at top dead center. In this assembly, it is easy to control the clearance volume, and the repeatability of the compressor's efficiency can be achieved by accurately controlling the height of the piston sleeve and the clearance volume. Thus, the known standard compressor piston assembly designs do not inhibit heat flow from the compressor head to the piston sleeve, and, hence, the cup seal, while providing for consistent compressor performance.

SUMMARY OF THE INVENTION

Accordingly, it is an object of the present invention to provide a piston assembly for use in a compressor that overcomes the shortcomings of piston assemblies in conventional compressors. More specifically, it is an object of the present invention to provide a piston assembly that reduces the temperature of the piston sleeve resulting from heat conduction from the heat of compression originating in the compressor head through the valve plate to the piston sleeve.

Furthermore, it is an object of the present invention to reduce the temperature of the piston sleeve by providing 1) a nonconductive air gap between the compressor head and the valve plate, 2) increased surface area around the compressor head and valve plate for increased convective cooling of these surfaces, and 3) a radiant heat barrier between the compressor head and the valve plate for radiating heat from the compressor head, valve plate, or connection assembly joining the two.

These objects are achieved according to one embodiment of the present invention by providing a piston assembly that includes a piston sleeve having a top portion, a valve plate supported by the top portion of the piston sleeve, and a compressor head having a compressor head plate offset from the valve plate. By offsetting the compressor head plate form the valve plate, a cooling chamber is defined between the compressor head plate and the valve plate. In a preferred embodiment, this cooling chamber is open to atmosphere to maximize the surface area for convection cooling of the compressor head plate and the valve plate, thereby minimizing the amount of heat transferred to the piston sleeve. A conduit, preferably defined by a thermo-insulating material, traverses the cooling chamber to communicate gas between the interior of the piston sleeve and the interior of the compressor head via openings in the valve plate and the compressor head plate.

Additionally, it is an object of the present invention to provide a durable piston assembly containing a hard joint between the valve plate and the piston sleeve for providing a compressor assembly having a fixed clearance therebetween.

These and other objects, features and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

DETAILED DESCRIPTION OF THE PRESENTLY PREFERRED EMBODIMENTS OF THE INVENTION

Figure 1:
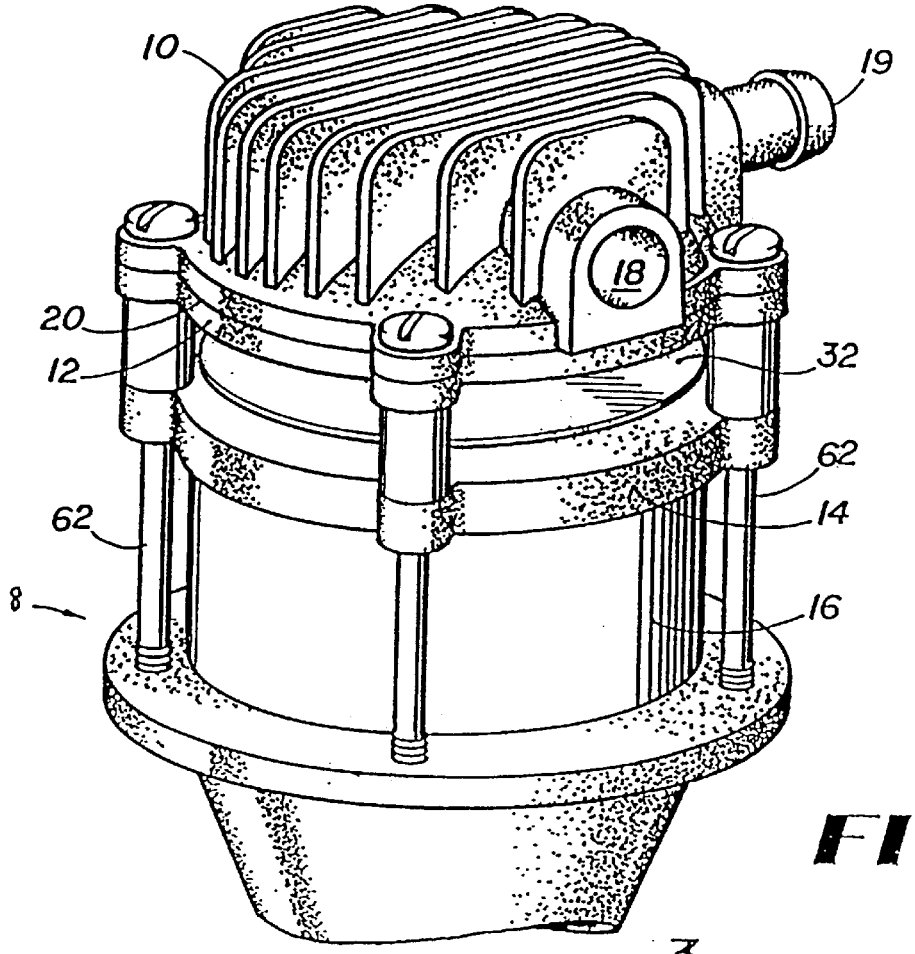
FIG. 1 is a perspective view of a compressor assembly housing a piston assembly according to the principles of the present invention.
Figure 2:
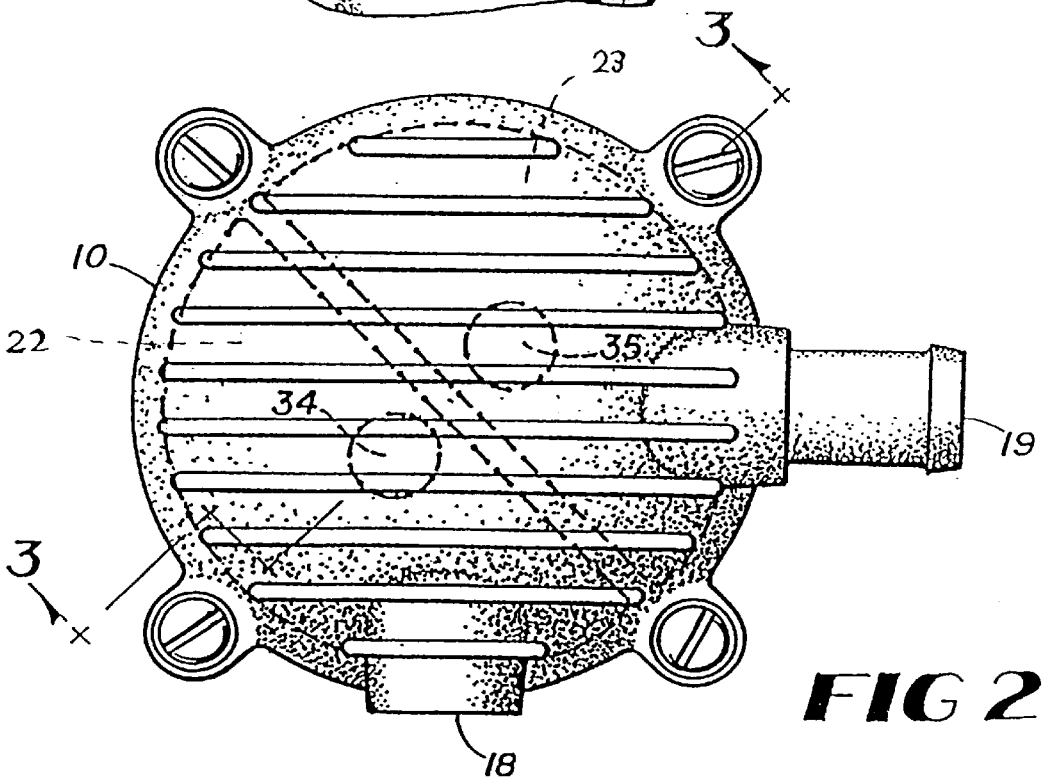
FIG. 2 is a top perspective view of a compressor assembly housing according to the present invention.

Referring now to the drawings, the invention will be described in more detail. FIGS. 1 and 2, illustrate a piston assembly 8 for use in a compressor assembly (not shown). Piston assembly 8 includes a compressor head 10, a compressor head plate 12, a valve plate 14, a piston sleeve 16, a gas intake port 18, and a gas exhaust port 19. Compressor head 10 includes a bottom 20, which abuts compressor head plate 12 defining an internal gas chamber 22 that communicates with gas intake port 18 and an internal compression chamber 23 that communicates with gas exhaust port 19. Compressor head plate 12 includes a first compressor head plate opening 24 defined therein and a second compressor head plate opening 26 also defined therein. Piston sleeve 16 includes a top portion 27, which supports valve plate 14. Valve plate 14 includes a first valve plate opening 28 and a second valve plate opening 30 defined therein.

Figure 3:
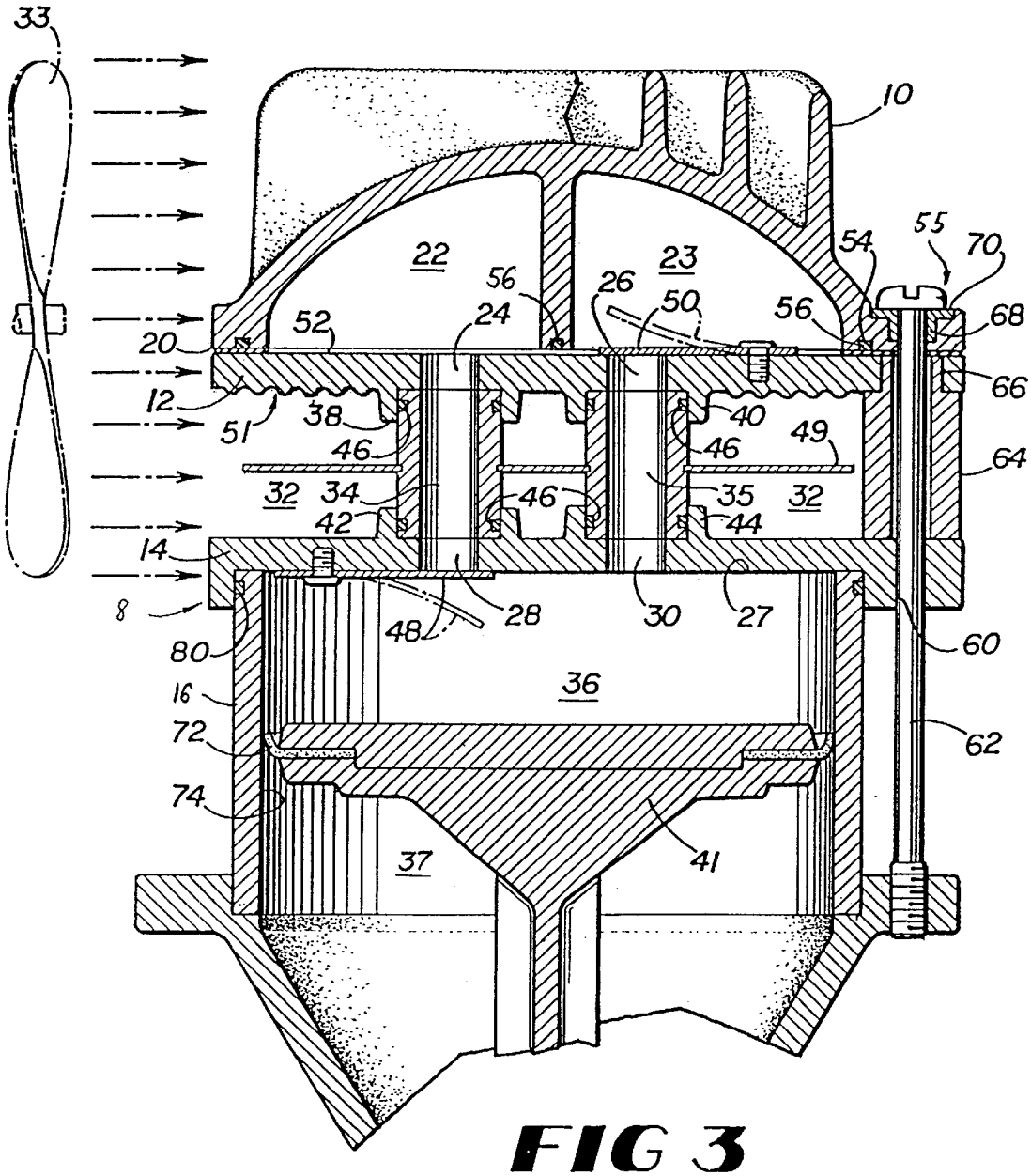
FIG. 3 is a sectional view taken along line 3—3 of FIG. 2 illustrating the piston assembly area according to the principles of the present invention.

As shown in FIG. 3, compressor head plate 12 is offset from valve plate 14 so as to define a cooling chamber 32 between the compressor head plate and the valve plate. This offset positioning between valve plate 14 and compressor head plate 12 inhibits heat, which is generated by the compression of gas in internal compression chamber 23, from flowing from compressor head 10 via conduction through valve plate 14 to piston sleeve 16. Additionally, in a preferred embodiment of the present invention, the offset positioning of valve plate 14 with respect to compressor head plate 12 enables cooling chamber 32 to communicate with the ambient environment for dissipating heat from the bottom of compressor head plate 12 to the ambient environment. In addition, valve plate 14 can also dissipate heat via the exposed surface of valve plate 14 to cooling chamber 32. With compressor head plate 12 offset from valve plate 14, compressor head 10 is exposed to the ambient environment along its top, sides, and bottom, thereby increasing the surface area for convective cooling. In the preferred embodiment, a cooling fan 33 generates a cooling current for convecting heat away from compressor head 10, including from the compressor bottom through cooling chamber 32 and into the ambient environment.

An intake conduit 34 and an exhaust conduit 35 traverse cooling chamber 32 for communicating gas between compressor head plate 12 and valve plate 14. Intake conduit 34 traverses cooling chamber 32 and fluidly connects first compressor head plate opening 24 with first valve plate opening 28 enabling gas to be drawn through intake port 18 to piston sleeve interior 36 when a piston 41 in piston sleeve 16 travels in a downward stroke. Exhaust conduit 35 also traverses cooling chamber 32 and fluidly connects second valve plate opening 30 with second compressor head opening 26 enabling gas compressed by piston 41 when traveling in an upward stroke to be delivered into internal compression chamber 23 and exit compressor head 10 through gas exhaust port 19.

In the illustrated preferred embodiment, separate gas channels 34 and 35 are utilized for communicating gas between compressor head 10 and piston sleeve 16. It is to be understood, however, that a singular bisected conduit or other conduit variations may be utilized for this purpose. For example, a single conduit can be used as gas channels 34 and 35 so long as an appropriate valve is provided for controlling the flow of gas or fluid between the interior of the piston sleeve and the interior of the compressor head. Also, more than one gas channel 34 can be used to communicate gas between gas chamber 22 and sleeve interior 36 and more than one gas channel 35 can be used to communicate gas between sleeve interior 36 and compression chamber 23. Additionally, in the preferred embodiment, intake conduit 34 and exhaust conduit 35 are made of a thermo-insulating material that inhibits heat from conducting from compressor head plate 12 to valve plate 14. FIG. 2 illustrates the bifurcation of compression head 10 into internal gas chamber 22 and internal compression chamber 23, with intake conduit 34 and exhaust conduit 35.

The present invention also contemplates introducing the gas to be compressed into an area 37, which is on a side of piston 41 opposite sleeve interior 36, so that the internal gas chamber 22 in compressor head 10 and channel 34 can be eliminated. In this embodiment, a channel and a one-way valve is preferably provided on piston 41 to allow gas to pass from area 37 through piston 41 and into sleeve interior 36 for compression during an upstroke of piston 44.

To facilitate the positioning of intake conduit 34 and exhaust conduit 35, compressor head plate 12 includes a compressor head plate intake conduit seat 38 and a compressor head plate exhaust conduit seat 40, while valve plate 14 includes a valve plate intake conduit seat 42 and an valve plate exhaust conduit seat 44 for receiving intake conduit 34 and exhaust conduit 35, respectively. O-rings 46 are disposed within the respective conduit seats. A one-way intake valve 48 regulates passage of gas from internal gas chamber 22 to piston sleeve interior 36, and a one-way exhaust valve 50 regulates passage of gas from piston sleeve interior 36 to internal compression chamber 23.

The offset between compressor head plate 12 and valve plate 14 defining cooling chamber 32 enables heat resulting from compression of gas within internal head compression chamber 23 to dissipate through the air located within cooling chamber 32. Heat is also dissipated through the air located around the top of compressor head 10. In the preferred embodiment, cooling fan 33 produces a current of airflow through cooling chamber 32 for removing heat from compressor head plate 12, compressor head 10, valve plate 14, and other associated structures, such as conduits 34 and 35, to the ambient environment. This configuration provides for lower conductivity of heat from the compressor head to the valve plate and also provides additional cooling through convective cooling by increasing the surface area of the piston assembly exposed to the ambient environment.

Although the figures illustrate air as a thermo-insulating medium disposed in cooling chamber 32 between the compressor head plate and the valve plate, it is to be understood that other thermo-insulating medium can be provided in this chamber. For example, the present invention contemplates circulating a cooling fluid, such as water, through the cooling chamber. A further embodiment contemplates providing a foam insulation, fiberglass insulation, or combinations of thermo-insulating materials in cooling chamber 32.

Studies have shown that having a 0.1 inch gap between compressor head plate 12 and valve plate 14 results in a decrease in the temperature of piston sleeve 16 of twelve degrees Celsius (12° C.) as compared to a conventional compressor assembly lacking a compressor head plate, wherein the valve plate 14 is directly in contact with the compressor head. Other studies have shown that a twelve degree Celsius reduction could increase the lifetime of a compressor from two thousand (2,000) hours to more than eight (8,000) thousand hours depending on the general surrounding temperature.

The present invention contemplates further reducing the temperature of piston sleeve 16 by providing a radiant barrier 49 within cooling chamber 32 between compressor head plate 12 and valve plate 14. In the illustrated embodiment, radiant barrier 49 is a single vane coupled to conduits 34 and 35 generally bisecting cooling chamber 32. It is to be understood, however, that a variety of other configurations and locations are possible. For example, multiple vanes can be coupled to conduits 34 and 35, as well as to compressor head plate 12 and valve plate 14 directly. Radiant barrier 49 is preferably made of a heat conductive material, such as aluminum.

To further facilitate the removal of heat from compressor head 10, the bottom surface of compressor head plate 12 may include an augmented heat transfer surface 51, which is the illustrated embodiment is a contoured surface that increases the heat transfer coefficient of compressor head plate 12. A similar surface can be provided on the upper surface of valve plate 14, as well as on other surfaces, such as the exposed surfaces of conduits 34 and 35. Of course other designs may be used to facilitate the creation of laminar or turbulent flows of air through cooling chamber 32 for increasing the cooling properties of the invention. For example, fins, pins, protrusions or other heat radiating materials and configurations can be provided on the exposed surfaces of compressor head plate 12, valve plate 14, or both.

As shown in FIG. 3, a compressor head gasket 52 is disposed between compressor head 10 and compressor head plate 12. Compressor head 10 has a compressor head groove 54, which receives a compressor head o-ring 56 providing a sealed environment. In the preferred embodiment, compressor head 10 is retained with piston sleeve 16 by hard joint, generally indicated at 55. Hard joint 55 includes spacer elements 64, which preferably are made of a thermo-insulating material, inhibiting heat from conducting from compressor head plate 12 to valve plate 14. Bolt holes 60 are defined within compressor head 10, compressor head plate 12, valve plate 14, piston sleeve 16 and spacer elements 64. Bolts 62 are received within the respective bolt holes for securing compressor head 10 with piston sleeve 16. Spacer elements 64 are disposed between compressor head plate 12 and valve plate 14 assisting in positioning compressor head plate 12 offset from valve plate 14. Spacer elements 64 firmly abut compressor head plate 12 and valve plate 14 when bolts 62 are in position, thereby assisting in the establishment of hard joint 55.

In the illustrated exemplary embodiment, spacer elements 64 include a nose end 66, which is received within the respective bolt holes 60 of compressor head plate 12, insulating bolts 62 from contact with compressor head plate 12. Each bolt hole 60 of compressor head 10 includes a bolt seat 68 aligned with the bolt holes. A bushing 70 is received within the respective bolt hole 60 of compressor head 10. Bushing 70 is made of a thermo-insulating material to insulate bolts 62 from compressor head 10. When bolts 62 are firmly positioned, connecting compressor head 10, compressor head plate 12, valve plate 14 and piston sleeve 16 together, a hard joint is established with the bolts insulated from compressor head 10 and compressor head plate 12. The establishment of hard joint 55 enables a fixed clearance between the top of the piston and the valve plate to be established when the piston is at top dead center, thereby establishing the repeatability of the compressor's efficiency. An o-ring 80 is disposed between valve plate 14 and piston sleeve 16 defining a pressurized seal.

In operation, gas enters piston sleeve interior 36 through intake valve 48, which is compressed by piston through exhaust conduit 35 into internal compression chamber 23. A cup seal 72 engages interior wall 74 of piston sleeve 16 to form a seal between the pressurized side and the non-pressurized side of piston sleeve interior 36. The engagement point of cup seal 72 and interior wall 74 of piston sleeve 16 is the point of heat conduction to cup seal 72. To reduce heat flow to piston sleeve 16 and ultimately cup seal 72 cooling chamber 32 inhibits the heat generated by compression from reaching piston sleeve 16.

Studies have shown that the overall design of utilizing an offset between the compressor head and valve plate not only lowers the temperature of the piston sleeve, but also lowers the discharge temperature of the pressurized gas leaving the compressor head. Increasing the surface area of compressor head 10 by exposing compressor head bottom 20 via compressor head plate 12, removes more heat from internal compression chamber 23 via convection through compressor head 10 than is possible in conventional piston assemblies, thereby lowering the temperature of the gas within the compressor head below that possible in conventional devices. Thus, it has been shown to be advantageous to define a cooling chamber by offsetting the compressor head with the valve plate in a hard joint assembly. When the compressor head is offset from the valve plate, heat flow from the compressor head to the piston sleeve is inhibited, reducing the temperature of the piston sleeve and thus the temperature of the cup seal which extends the life of the cup seal and ultimately the life of the compressor.

While the preferred embodiment of the piston assembly discussed above and illustrated in the figures shows the compressor head mounted directly to the piston sleeve so that both move as a unit, it is to be understood that these two elements need not be directly coupled to one another. On the contrary, the present invention contemplates that each element can be mounted, for example, on separate portions of a housing, with channel 35 or channels 34 and 35 communicating gas between the two.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims.

What is claimed is:

1. A piston assembly in a compressor, comprising:

a piston sleeve having a top portion;

a valve plate supported by the top portion of the piston sleeve and having a first valve plate opening defined therein;

a compressor head having a compressor head plate offset from the valve plate such that a cooling chamber is defined between the compressor head plate and the valve plate, the compressor head plate having a first compressor head opening defined therein, wherein the cooling chamber is open to ambient atmosphere; and a conduit traversing the cooling chamber to communicate gas between the valve plate opening and the compressor head opening.

2. The piston assembly of claim 1, wherein the compressor head plate and the valve plate are positioned in generally parallel planes.

3. The piston assembly of claim 1, wherein the compressor head plate and the valve plate are generally coaxially aligned.

4. The piston assembly of claim 1, wherein the conduit is formed from a rigid, non-compressible, thermo-insulating material.

5. The piston assembly of claim 1, further comprising a radiant barrier disposed within the cooling chamber between the compressor head plate and the valve plate.

6. The piston assembly of claim 1, further comprising a cooling fan relative to the cooling chamber so as to direct a cooling gas flow through the cooling chamber.

7. The piston assembly of claim 1, further comprising at least one spacer formed from a thermo-insulating material abutting the compressor head plate and the valve plate.

8. The piston assembly of claim 1, further comprising an insulating barrier disposed within the cooling chamber for reducing conduction of heat from the compressor head plate to the valve plate.

9. The piston assembly of claim 1, wherein at least one of a surface of the compressor head plate adjacent the cooling chamber and a surface of the valve plate adjacent the cooling chamber further includes a heat radiating structure.

10. The piston assembly of claim 1, wherein the valve plate includes a second valve plate opening defined therein and the compressor head plate includes a second compressor head plate opening defined therein, and wherein the piston assembly further comprises an intake conduit fluidly connecting the first compressor head plate opening with the first valve plate opening and an exhaust conduit fluidly connecting the second compressor head plate opening with the second valve plate opening.

11. The piston assembly of claim 10, wherein the compressor head and compressor head plate define a gas chamber and a separate compression chamber, with the first compressor head plate opening communicating with the gas chamber and the second compressor head plate opening second communicating with the compression chamber.

12. The piston assembly of claim 1, further comprising a hard joint connection assembly coupling the valve plate to the top portion of the piston sleeve such that a clearance between valve plate to the top portion of the piston sleeve remains substantially unchanged during operation of the piston assembly.

13. The piston assembly of claim 1, further comprising a piston disposed in the piston sleeve so as to move within the piston sleeve in a reciprocating fashion.

14. The piston assembly of claim 1, further comprising a connection assembly adapted to directly couple the compressor head with at least one of the valve plate and the piston sleeve.

15. The piston assembly of claim 14, wherein the connection assembly comprises:

a plurality of spacer elements formed from a thermo-insulating material spanning the cooling chamber, wherein a fastener receiving channel is defined in each spacer element; and a plurality of fasteners that coordinate fixation of the compressor head plate with respect to the valve plate and the piston sleeve, wherein each fastener is disposed in an associated fastener receiving channel in a spacer element.

16. The piston assembly of claim 15, further comprising a bushing formed from a thermo-insulating material to thermally isolate the fasteners from the compressor head.

17. A piston assembly of a compressor, comprising:

a piston sleeve having a top portion;

a valve plate supported by the top portion of the piston sleeve and having a first valve plate opening defined therein;

a compressor head having a compressor head plate offset from the valve plate such that a cooling chamber is defined between the compressor head plate and the valve plate, the compressor head plate having a first compressor head opening defined therein;

a conduit traversing the cooling chamber to communicate gas between the valve plate opening and the compressor head opening; and an insulating barrier disposed within the cooling chamber for reducing conduction of heat from the compressor head plate to the valve plate.

18. A piston assembly of a compressor, comprising:

a piston sleeve having a top portion;

a valve plate supported by the top portion of the piston sleeve and having a first valve plate opening and a second valve plate opening defined therein;

a compressor head having a compressor head plate offset from the valve plate such that a cooling chamber is defined between the compressor head plate and the valve plate, the compressor head plate having a first compressor head opening and a second compressor head plate opening defined therein;

a conduit traversing the cooling chamber to communicate gas between the valve plate opening and the compressor head opening;

an intake conduit fluidly connecting the first compressor head plate opening with the first valve plate opening; and an exhaust conduit fluidly connecting the second compressor head plate opening with the second valve plate opening.

19. The piston assembly of claim 18, wherein the compressor head and compressor head plate define a gas chamber and a separate compression chamber, with the first compressor head plate opening communicating with the gas chamber and the second compressor head plate opening second communicating with the compression chamber.

* * * * *